United States Patent [19]

Deskiewicz, Jr.

[11] Patent Number: 4,844,264

[45] Date of Patent: Jul. 4, 1989

[54] DISPLAY TRAY

[75] Inventor: Alfred J. Deskiewicz, Jr., County of King, Wash.

[73] Assignee: Realty Supply International, Inc., Issaquah, Wash.

[21] Appl. No.: 185,056

[22] Filed: Apr. 22, 1988

Related U.S. Application Data

[63] Continuation-in-part of Ser. No. 47,054, May 4, 1987.

[51] Int. Cl.[4] ..... A47F 7/00

[52] U.S. Cl. ..... 211/50; 206/561; 206/564; D6/406; D6/420; D19/91

[58] Field of Search ..... 211/50, 55, 11, 126; D6/406, 419, 420; D19/86, 90, 91; 206/561, 564, 45.10; 220/20, 21, 22; 248/220.2, 222.2; 403/245; 40/124.2

[56] References Cited

U.S. PATENT DOCUMENTS

| | | | |
|---|---|---|---|
| D. 282,757 | 2/1986 | Cohen | D19/86 |
| 1,575,696 | 3/1926 | LaSelle | 211/50 X |
| 1,713,601 | 5/1929 | Harris | 211/50 X |
| 2,242,296 | 5/1941 | Fraser | 211/126 X |
| 2,664,005 | 12/1953 | Kosinski | 211/70.7 X |
| 2,812,852 | 11/1957 | Samuels | 248/222.2 X |
| 2,876,780 | 3/1959 | Vogel | 211/50 X |
| 3,857,482 | 12/1974 | Shelton | 206/561 X |
| 4,357,119 | 11/1982 | Pollit | 403/245 X |

*Primary Examiner*—Ramon O. Ramirez
*Attorney, Agent, or Firm*—Seed and Berry

[57] ABSTRACT

A display tray for attractively displaying material at an angle with respect to the horizontal is described. The display tray has a main tray portion and a stand portion. The main tray portion and stand portion are removably attached. The main tray portion has a front compartment for holding business cards. When connected, the main tray and stand portions form two rear compartments for holding additional material, such as the business cards of prospective buyers. A slot in a tab extending from the main tray extends over a lug in the stand portion to form the removable connection. The shapes of the slot and lug permit the connecting and disconnecting of the main tray from the stand portion to be performed without tools.

20 Claims, 3 Drawing Sheets

FIG. 4
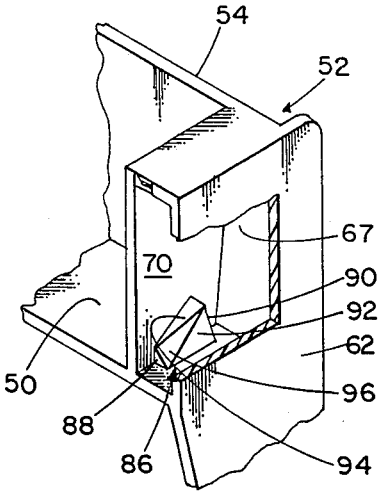
FIG. 5
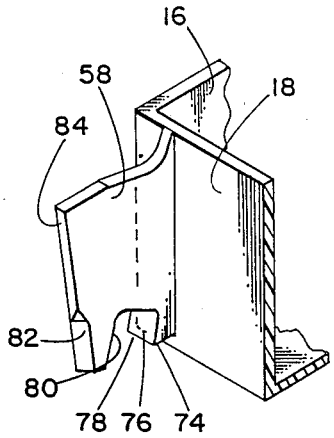
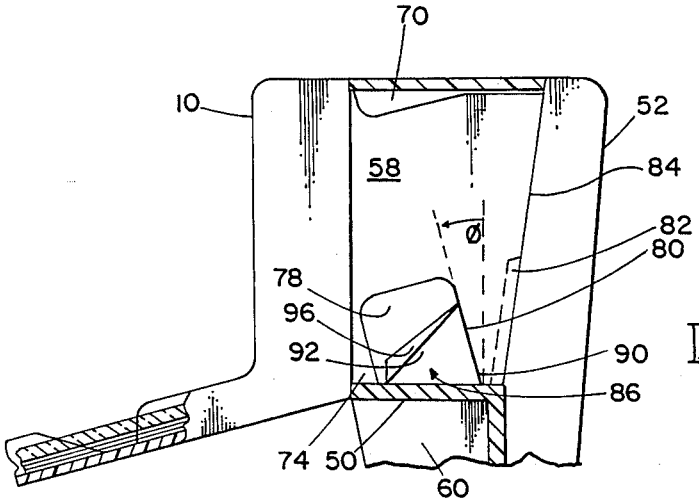
FIG. 6

DISPLAY TRAY

RELATED APPLICATIONS

This application is a continuation-in-part of an application titled "Organizer Rack", filed May 4, 1987, Ser. No. 047,054.

DESCRIPTION

1. Technical Field

This invention relates to display trays for advertising or other promotional material, and more particularly, to a portable display tray that attractively displays promotional material.

2. Background Art

There are numerous types of advertising where it is desirable that the person to whom the advertising is directed take a brochure or other paper with him so he may study it at his leisure at a different location. The seller would like to furnish this material to the prospective buyer in a neatly organized fashion so that the prospective buyer may easily take a written description of the product with him. Further, for many items sold in this manner, the number of prospective purchasers can be quite large. It is therefore desirable to have a large supply of information sheets or other advertising material on hand to aid the prospective buyers in making their decision to purchase the item.

In the past, promotional materials of this type were arranged in stacks on top of a small table or across a counter top in a reception area. The piles of material may be stacked side by side, even though they may be of different sizes or completely unrelated to each other.

Further, when a particular customer is looking at the brochures, he may easily mess up the piles and slide various copies of the materials on top of each other. This creates an extremely unattractive table top, plus making the finding of the promotional material by the next customer very difficult.

Further, the receptionist or other person who must put out the display material is required to remove the stacks each day or straighten piles of brochures a significant amount of time daily.

This problem is particularly acute in the selling of homes. In 1985, there were an average of 2,400,000 single housing units listed for sale in the United States on any typical day of that year. Standard real estate practices dictate certain routine procedures for such listings. These include the preparation of a one-to three-page flyer that describes the home's physical characteristics. A quantity of these flyers are placed at the premise being offered for sale to enable agents showing the property to accurately describe the property to their clients.

Such flyers are utilized for both new and resale properties and are recognized as a standard marketing tool by real estate professionals. In addition to the flyers, it is common practice for listing agents to leave a number of their business cards at their listings for the use of anyone viewing the property.

After a property is listed, it is previewed and/or shown by other real estate agents. "Previewing" is the accepted term that describes an agent's inspecting a property to determine if it meets the tastes and needs of his buyers without the potential buyers being present. "Showing" is the accepted term that describes an agent's showing of the home to potential buyers.

Whether an agent is previewing or showing a home, it is common realty practice for an agent to leave behind one of his business cards to indicate that he has visited the property. It is also common practice for a listing agent to regularly collect cards left at his listings and to count the number of cards, review any notes written on the cards, and contact each agent who visited the home so as to obtain information and feedback from the agents that may be of value in marketing the home.

Agents who have shown the home simply leave their cards sitting on top of the table among the flyers on display. The previewing agent may also leave a business card and may or may not return at a later time to bring a buyer through. In the event that the previewing agent returns as a showing agent, he will leave another business card or sign in again, thus causing further confusion. Confusion is created by having many different business cards on the table. A prospective buyer viewing the home sees many business cards from many agents scattered about on the display table and forms an opinion about the quality of the home or his ability to purchase it from the numbers and types of business cards.

Of course, from the point of view of the listing agent, it is unwise to have the names of other agents and their agencies visible on the display table, with his own cards sometimes being obscured from view by the mess on the table. This becomes advertising for agents who previously showed the home to a potential buyer, in that an agent may leave many of his business cards in each home that he previews or shows.

The present method agents utilize to display home flyers is to place a pile of them on some handy table top, many times the dinner or kitchen table top. It becomes the homeowne's chore to maintain the stack in an orderly fashion. Owners are also relied upon to organize showing agents' cards for the benefit of the listing agent. Since the previewing and showing agents many times do not indicate on their cards the function of the visit, but simply drop their cards on the table top, it is impossible to later use the number of cards to analyze the status of the marketing effort. Moreover, if the dinner or kitchen table top is used for other purposes, the flyers and business cards left by previewing and showing agents and the listing agent's business cards must be put in orderly stacks and moved to a different location before each meal and afterward returned.

The only physical items provided to a homeowner who listed his home usually were an outside "For Sale" sign stuck in the front yard, a keybox (optional), a stack of flyers, and a stack of the listing agent's business cards The only items that are continuously evident to the selling homeowner are the piles of business cards and flyers, which often become unkempt and lie in a state of disarray. Of course, business cards of previewing and showing agents dropped on the table are also a messy sight, not only to the homeowner but also to potential purchasers viewing the home.

One solution to this problem is to provide a sign-in sheet with a pencil for agents to sign and indicate if they are showing or previewing the home. This solution adds papers to the home display and does not solve the problem of unkempt stacks. Further, getting agents to "sign in" is often difficult.

These problems exist not only in the home selling industry but in all kinds of advertising industries which need to stack display brochures, often of different sizes, and business cards of a particular agent who would get a commission for selling an item.

DISCLOSURE OF THE INVENTION

It is therefore an object of this invention to provide a display tray for neatly and efficiently displaying promotional material.

It is a further object of this invention to display promotional material of different sizes including $8\frac{1}{2}'' \times 11''$ papers, business cards or odd-shaped brochures.

It is a further object of this invention to provide a compartment in the display where prospective buyers who have taken advertising material may leave their business cards or names in an organized manner.

These and other objects of the invention are accomplished by providing a display tray for attractively displaying brochures of different sizes, standard size flyers and business cards. The display tray is provided with a main compartment large enough to fit in a flat manner the $8\frac{1}{2}'' \times 11''$ size paper often used in promotional displays or full-color brochures. The display is also provided with a compartment at the front of the display which has dimensions to hold several dozen business cards at a time, with the text on the card easily viewable without removing the card from the compartment.

The display tray is also provided with two additional compartments at the back of the tray. These two additional compartments can be used according to the needs of the advertiser. In the event of advertising a home, a previewing agent or showing agent is directed to place his card in the respective compartment to indicate to the listing agent the nature of the visit. The display tray thus serves to collect and sort business cards between previewing and showing agents into two labeled, separate pockets. This avoids the need for a sign-in sheet. Further, the compartments are of such a shape that the business cards placed therein are not visible to people later viewing the advertising material. This prevents the showing agents from advertising with their cards and avoids confusion by prospective buyers.

The display tray of the present invention is comprised of two separate pieces, or in the alternative, of four different pieces. There is a main tray portion and a stand portion. The tray portion attractively displays at a sloped angle a quantity of listing flyers or multiple-page listing summaries. A front portion of this tray serves as a card holder and holds up to fifty of the listing agent's business cards. A stand portion is provided having upstanding legs. The stand portion removably attaches to the large main display tray. The connection of the stand portion to the main display tray is such that two additional compartments are formed at the back of the display tray. These compartments are slightly larger than standard business card size so that a business card placed therein is slightly down from the upper surface and the text thereon is out of sight. The main tray portion and stand portion may easily be assembled and disassembled repeatedly by hand.

The two optional parts of the display tray include a large listing display board at the rear and a clear protective cover to place over the last flyer in the main tray so that the seller can be sure that the very last flyer will not be taken from the display.

The display tray is easily portable while in use. All the sales material is on this single display tray. The homeowner may easily pick up the tray that contains all the material related to the sale of the home and move it to a new location in the event he must use the table or other surface on which the tray is placed.

The display tray is also useful for advertising items other than homes. For example, the two slots at the rear, which are slightly larger than a standard business card, can conveniently hold a brochure such as a trifold. These brochures may be placed standing up in an attractive display position at the back of the display tray.

BRIEF DESCRIPTION OF THE DRAWINGS

FIG. 4 is an enlarged fragmentary view of the stand portion of FIG. 3 showing the attachment lug in the stand portion.

FIG. 5 is an enlarged, fragmentary, rear isometric view of the main display tray portion, showing a connecting tab of the main display tray portion which cooperates with the attachment lug of the stand portion.

FIG. 6 is an enlarged, cross-sectional side view of the main display tray portion shown attached to the stand portion taken along lines 6—6 of FIG. 1.

BEST MODE FOR CARRYING OUT THE INVENTION

Figure 1:
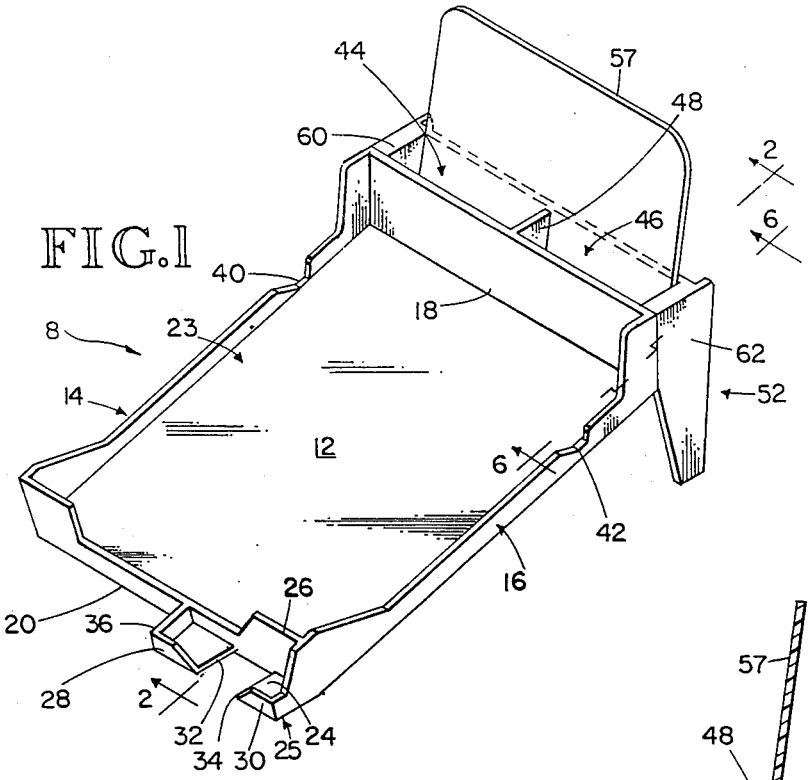
FIG. 1 is an isometric view of the display tray of the present invention.

The display tray is indicated generally by reference numeral 10 in the drawings. The display tray has a tray portion 12, the tray portion having a left wall 14 and a right wall 16. The tray portion also has a back wall 18, front wall 20 and bottom 22. The side walls, front and back walls, and bottom serve to form an upwardly open display compartment 23. This display compartment 23 is of a size to attractively hold standard advertising size material, such as $8\frac{1}{2}'' \times 11''$ flyers (not shown).

Attached to the front wall of the tray portion 12 is a business card display compartment 24. This front compartment 24 has as its right wall a forward extension wall 25 of the right wall 16 of the tray portion 12. The front compartment 24 also has an upstanding rear wall 26 formed as a part of the front wall 20 of the tray portion 12 and which is approximately the height of a business card for part of the length toward the right wall 26.

Figure 2:
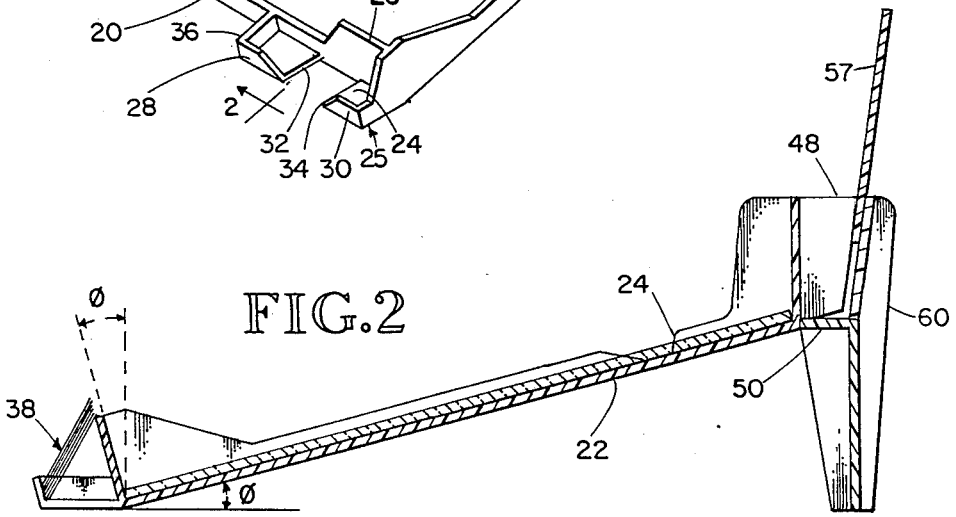
FIG. 2 is an enlarged cross-sectional view taken along lines 2—2 of FIG. 1 showing the display tray of the present invention.

The front business card display compartment 24 is also provided with a pair of laterally spaced-apart front walls 28 and 30. Associated with each of the front walls 28 and 30 and extending between the corresponding front wall and the rear wall 26 are bottom walls 32 and 34. A left side wall 36 is also provided for the compartment 24. The rear wall 26 of compartment 24 is at an angle with respect to the vertical, such that with a business card 38 in the compartment, the card is held in a rearwardly slanted position, such as at 60° or 75° from the vertical, to improve the visibility of its text to the viewer without removing the card from the compartment. In this position, the lower edge of the card, when in the compartment 24, abuts at its corners against front walls 28 and 30 and is held propped up from the rear by rear wall 26. The manner in which a stack of business cards is placed in this display is shown in FIG. 2, which illustrates a large number of business cards 38 placed in the front business card display compartment 24. The front compartment 24 has a very low profile on the front wall and is retained at the corners so that the entire business card is attractively displayed and generally readable without removal. Further, the angle at which the business cards are displayed is different from the angle at which the larger flyers are displayed in order to accent them and present a very attractive display as a whole. This compartment is shown at one side of the front, but could be centered or on the other side if desired.

The corner portions of side walls 14 and 16 are raised, as are the corresponding corner portions of the front wall 20, to provide enclosure and protection for the flyers which will be placed inside the large display tray portion 12. The intermediate portions of walls 14, 16 and 20 are shorter in height. Thus, the flyers which are placed therein will be attractively displayed and the focus will be on the flyers instead of on the walls which surround the flyers. Further, having the corners of the walls raised permits a very large stack of flyers to be placed inside the tray such that the flyers may extend well above the low-profile wall portion if desired. This permits the display of the flyers to be attractive yet secure. In one embodiment, the left and right side walls 14 and 16 are provided with slots 40 and 42, respectively, to permit easy hand-removal of the flyers by a prospective purchaser or his agent.

Rear wall 18 is of uniform height along its entire length, which is slightly taller than the height of a standard size business card, and is manufactured of an opaque material. Today the standard business card measures $3\frac{1}{2}'' \times 2''$, so the rear wall 18 is made 2" in height or may be made slightly higher if desired. The rear wall 18 serves as a forward wall for a pair of left and right upper business card compartments 44 and 46, respectively. The purpose of making rear wall 18 so high is to conceal any business cards which may be placed therebehind in one of the left or right upper compartments 44 or 46 so that the face of the card may not be seen when the tray is in its standard use condition. In order to read business cards which have been placed behind wall 18 in compartments 44 and 46, the business cards must be removed.

Figure 7:
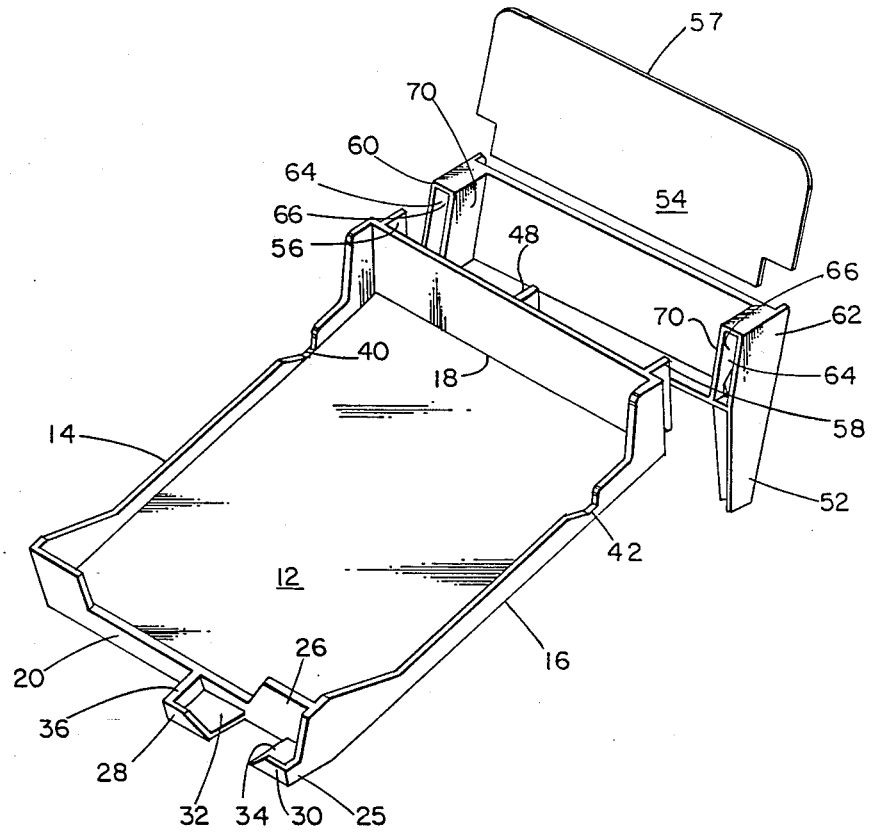
FIG. 7 is an exploded isometric view of the display tray of showing the components of the display tray.

Back wall 18 has extending rearwardly from it a central upstanding wall portion 48, as can be seen in FIGS. 1, 2 and 7. The upstanding wall portion 48 extends generally along the height of wall 18 from the top to the bottom and is attached to the back of the wall; however, a small space is left at the bottom of wall 18 where the tab 48 does not extend, so when the stand portion is attached to the tray portion, the bottom wall of the tray portion 50 is flush and in contact with the back of the back wall 18, as shown in FIG. 2. Wall portion 48 becomes a wall when a stand portion 52, formed as a separate part in the presently preferred embodiment, is attached to the tray portion 12 and serves as a divider wall between the two upper business card compartments 44 and 46. The compartments 44 and 46 are further defined by a bottom wall 50 and a back wall 54 which extend laterally almost the full width of the tray portion 12.

Tray portion 10 has left and right connecting tabs 56 and 58, respectively, extending rearwardly from the back wall 18. These connecting tabs are of a shape and size to advantageously effect easy and firm connection between the tray portion 10 and stand portion 52. In particular, as best shown in FIGS. 5 and 6, the right connecting tab 58 extends from back wall 18, leaving a small space below its lowest edge wall 74 to permit the bottom wall 50 of the stand portion 52 to fit flush against back wall 18. FIG. 6 is a partial cross section taken generally along lines 6—6 of FIG. 1. Connecting tab 58 includes a notch 78 defined by a back edge wall 80 and a front edge wall 76. The notch 78 extends at an angle such that front edge wall 76 is shorter than back edge wall 80. The advantageous relationship between the edge walls and the shape of notch 78 will be described below. Further, connecting tab 58 has a back edge wall 84 which is flat toward the top of the wall, but which has a sloped portion 82 toward the bottom of the wall. The height of the sloped portion 82 is slightly higher than the height of back edge wall 80 of the notch 78 and is slightly higher than or equal to the highest portion of a correspondingly located, mating connecting lug 86 formed on the stand portion 52. Connecting tabs 56 and 58 are integrally formed with tray portion 10 and are connected at opposite ends of wall 18. The distance between connecting tabs 56 and 58 is slightly greater than two business cards placed end-to-end, such that placing divider wall portion 48 in the middle between the two connecting tabs serves to create the two separate card compartments 44 and 46, each compartment being long enough to hold a standard business card.

In the present preferred embodiment, the tray portion 10 has an outside width of 9" and an inside width of $8\frac{3}{4}''$. Thus, placing the connecting tabs 56 and 58 at or near the corners of back wall 18 provides a distance between each of the connecting tabs and the divider wall portion 48 of greater than 4". Thus, when the tray portion is connected to the stand portion 52, there are two compartments of proper size to adequately contain business cards which may be placed therein, one for previewing agents' cards and one for showing agents' cards. The connecting tabs 56 and 58 project rearwardly slightly farther than divider wall portion 48 to leave a space between the divider wall portion and the back wall 54 of the stand portion 52 to receive therebetween an ad card 57.

Stand portion 52 is provided with left and right leg portions 60 and 62, respectively. Stand portion 52 is also provided with left and right slots 64 and 66, respectively, with a laterally outside wall of each slot being formed by the corresponding leg portion 60 or 62. The lateral inside wall of the slot is formed by an interior wall 70. The interior wall extends forwardly from back wall 54. A connecting lug 86 is located within each of the slots 64 or 66, and the slot has a width sufficient to receive the corresponding connecting tab 44 or 46 therein.

Connecting tabs 56 and 58 working with the two connecting lugs 86 serve to firmly connect the stand portion 52 to the tray portion 10. Connecting lug 86 is shaped to easily facilitate insertion of the connecting tabs 44 and 46, plus provide a firm connection. As best shown in FIG. 4, connecting lug 86 has a very short front wall 88, but a relatively tall back wall 90. The front wall 88 can be as small as desired and could be a point if desired. Connecting lug 86 also has a side wall 92 and a top wall 94. Beginning at front wall 88 and running to the back wall 90 is a sloped portion 96 which is sloped at an angle between top wall 94 and side wall 92. The back wall 90 is flat; however, it is at an angle with respect to the vertical.

The advantageous connection between connecting tab 56 or 58 and the corresponding connecting lug 86 is provided by the particular shapes of each. The connecting tab is slid into the corresponding slot 64 or 66, and into connection and solid contact with lug 86, as shown in FIG. 6. This is accomplished as follows. The connecting tab 56 or 58, having sloped portion 82 on back edge wall 84, is brought into the corresponding slot 64 or 66. The sloped portion 82 contacts the sloped portion 96 of upstanding connection lug 86. The sloped portion 96 is at a very gradual slope toward back wall 90, with the thickness and height of the lug increasing as the lug extends rearward. The connecting tab is easily slid along sloped portion 96, with contact force on edge wall 82 causing slight flexion of the connecting tab laterally outward as the thickness of lug 86 gradually increases. To begin the connecting motion, only a very small amount of force is required and can be easily applied by hand by a person. As the connecting tab advances along lug 86, the two incline surfaces of the sloped portions 96 and 82 slide over each other as connecting tab 72 is flexed outward. When the sloped portion 82 reaches the end of lug 86, the connecting tab 72 snaps inward behind the lug 86 and returns to its unflexed position. Once connected, back edge wall 80 of the connecting tab end is in rigid contact with and behind back wall 90, with the connecting tab 72 having notch 78 completely over the lug and with the connecting tab back edge wall 84 extending flush along back wall 54. In this position, the entire connecting tab is completely within the slot, and back wall 18 of tray portion 10 is positioned tightly against the front of stand portion 52. The slot 78 is sloped upward in the same manner as connecting lug 86. Thus, back wall 80 is flush against wall 90 of lug 86 along its entire length. As shown in FIG. 6, the slot 78 is slightly larger than lug 86 so that the entire lug can fit within the slot.

As shown in FIG. 6, there is a slight space between wall 76 and the front of the lug 88; however, this distance can be relatively small or nonexistent if exact tolerances are required. Usually, a small space is left to permit flexibility in use and manufacture to ensure that the slot 78 will fit over tab 86. Connecting and disconnecting stand portion 52 to tray portion 10 is thus extremely easy and can be performed by any consumer who purchases the display tray. No tools, glue, screens, etc., are required for assembly. The display tray may be made cheaply and easily from two separate pieces and sold and shipped as two separate pieces to be assembled by the customer.

A further advantage provided by the advantageous shape of the connecting lug and connecting means 58 is that they can be easily disconnected from each other so that the tray portion and stand portion can be connected and then disconnected and once again placed in the flat and easy-to-transport condition.

Figure 3:
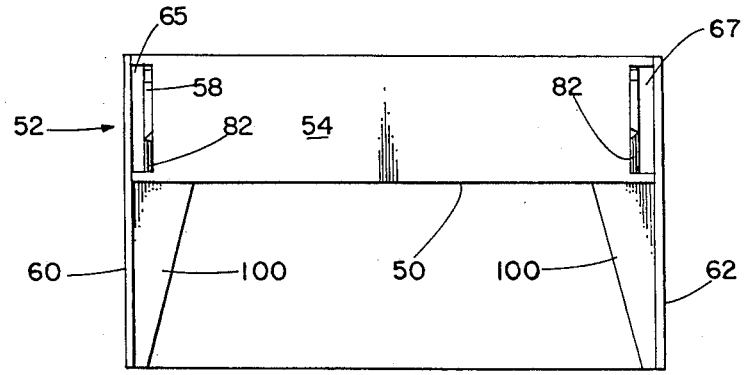
FIG. 3 is a rear view of the display tray of FIG. 1.

The method by which the stand portion 52 and the tray portion 10 can be removed from each other will now be described. As seen in FIGS. 5 and 6, extended connection portion 58 has a sloped rear wall portion 82 which facilitates connection around lug 86 along incline 96. The incline 82 also provides a separate function which is useful and independent of its function as an incline plane to facilitate connection. Slots 64 and 66 have rear openings 65 and 67, respectively, as shown in FIGS. 3 and 4. Therefore, the connecting lug and connecting tab 58 are accessible through the rear opening of the slot.

At the rear of the slot, the back wall 84 and sloped wall 82 can be seen and are accessible by a person desiring to disassemble the display tray. The extending tab 58 is flush against wall 70 within the slot. This provides for firm connection and no wobble from side to side. However, the angled portion 82 at the bottom of tab 58 is sloped outward such that there is a portion of the back wall 84 which is not flush against the wall 70. This portion 82 therefore provides a point of contact for a person desiring to flex or pry tab 58 outward from wall 70. A person may therefore place his thumbs or a small tool along sloped portion 82 and press outward to deflect tab 72 away from wall 70 and into an open part of the slot. The pressure applied at 82 outward serves to flex the tab 72 outward. When the tab 72 has been extended outward from wall 70 a distance greater than the width of lug 86, then the connecting tab is no longer around lug 86. The tray portion may be slid forward while the stand portion is slid backward or held stationary, and the tray portion may be easily removed from the stand portion. Once separated, the stand portion and the tray portion may each lie flat for easy carrying in an envelope or other flat place, such as a briefcase. The particular design of lug 86 in connection with upstanding tab 58 permits this assembly and disassembly to take place using no tools at all. Rather, only the hands of the person assembling or disassembling the tray need be used in order to perform the desired operation.

This particular arrangement, providing for the hand assembly and disassembly of the display tray, makes it particularly attractive to people selling items away from their main place of business, such as a home or a boat. The agent selling the item may easily carry the display tray in the disassembled condition in his briefcase or in his hand along with a flat stack of flyers to go in the display tray. Upon entering the home or other place where the advertisement is to be displayed, the person may easily and in a very short period of time hand-assemble the display tray. After the display tray is assembled, it may then be placed at the appropriate location within the home, with the business cards and flyers placed thereon for attractive display. Then, a short while later, after the home has sold, the agent may easily disassemble the tray, lay it flat and transport it.

As shown in FIGS. 1 and 2, the back wall 54 is a unitary piece and, in one embodiment, extends to a considerable height, for example, 7 to 10 inches and 4 to 7 inches above the height of back wall 18. This extending portion may be used as a support for large brochures or trifolds, which may be placed in compartments 44 and 46. This display tray has found attractive use in many fields and is useful in displaying brochures of many different sizes and heights such that a standard size flyer fits in display tray 12 and a folded flyer stands upright, resting against back wall 54.

The divider wall portion 48 is made to extend so that it is not quite flush with back wall 54, and a small space, for example, ¼ inch, is left between back wall 54 and rearwardly extending divider wall portion 48. An interchangeable ad card 57, as shown in FIG. 7, may be placed running along the entire length of wall 54, at the rear of upper business card compartments 44 and 48. This ad card may therefore be made considerably longer than either of the compartments 44 and 46 permit alone, and may extend upward to any desired height. The divider wall portion 48 holds the ad card in an upright position for easy viewing. The ad card may be customized for specific uses to colorfully display the material, including advertising for the listing agent, or provide directions, such as directing that previewing agents place cards in compartment 44 and showing agents place cards in compartment 46. The ad card 57 is interchangeable very easily, and the relationship between wall 48 and back wall 54 is such as to permit many different ad cards to be placed therein or one thick card with wall 48 acting to restrain the card on one side and wall 54 holding the card on the other side, such that it is held in a firm relationship and does not fall out of place. Wall 48 may be slightly longer to permit only a few thin sheets of paper to be placed upstanding therein if desired.

The display tray 10 is made so that the tray portion 12 attractively displays flyers contained therein at an angle which is pleasing and easy to read for the potential buyer. As shown in FIG. 2, the leg portions 60 and 62 and the length of the tray portion 12 can be such as to mount the tray portion at an angle phi ($\phi$) with respect to the horizontal. This angle phi ($\phi$) is preferably 15°; however, a different angle can be if desired, as long as the front wall corners are high enough to retain the flyers. An angle in the range of less than 45° and greater than 10° is also preferred.

The tray portion 12, as shown in FIG. 2, is made such that the bottom walls 32 and 34 of the front business card display compartment 24 will lie flat against the surface on which the display tray 10 is supported. As shown in FIG. 2, this requires that the bottom walls 32 and 34 and the lower edges of the left and right side walls 25 and 36 extend at the angle phi relative to the tray portion bottom 22 equal to the display angle of the tray portion 12 with the leg portion 52 connected. This also results in angling the front wall 20 relative to the vertical at the same angle phi as shown in FIG. 2. The front compartment 24 is flat with the support surface for its entire length when the tray is assembled. This provides an attractive display which is stable and neat and has full support along the entire front. In the preferred embodiment described herein, the connection lug 86 slopes upward along wall 90 at the back side of the wall at exactly the same angle as the tray with respect to the vertical. Use of the same angle at both locations provides for a complete contact along the entire wall between 80 and 90 and also contact with the flat surface along the front of the tray at front wall 20. The connection tab 58 is also provided with a slot which has similar angles to appropriately engage connection lug 86. The entire tray assembly when assembled is therefore provided in a combination with all of the parts working together to provide an attractive display tray which is stable and which is easy to assemble and disassemble. Further, by use of the same angles in the slope of the tray and the various contact portions where the parts are connected, stress is avoided and undue forces are not applied to particular locations in the display tray. In this way, the display tray has a long life and is easy to use. Other parts of the tray, such as the back wall, are sloped with respect to the vertical at 15° or phi ($\phi$) to provide a uniform attractive display at an attractive angle. Other portions of the display tray are made straight or at particular angles to provide attractive display. Material is thus displayed at three separate angles, the main tray being at one angle, the front compartment used to display the cards being at a different angle and the back wall 54 extending above the tray being at still a third angle. In this particular embodiment, the cards are displayed at the complement angle as the main tray portion. That is, if the main tray is displayed at an angle of phi, the small compartment wall 26 is an angle of 90° − phi with respect to the horizontal or at an angle of phi with respect to the vertical. Other angles could be used if desired, but this particular arrangement has been found to be attractive to consumers.

Tray portion 10 is formed as a single unitary piece and may be made by many methods well known in the industry. A preferred method of making tray 10 is by a standard molding process using a plastic or other suitable material. One method that has been used successfully is a molding process using styrene. Similarly, stand portion 52 is a single unitary piece which is made by a standard molding process well known in the industry and can be made from the same material as tray portion 10.

The invention has been described with respect to a variety of embodiments, and variations from these embodiments as would be obvious to those skilled in the art is within the scope of this invention.

I claim:

1. A display tray comprising:

a main tray member having a bottom positioned at a selected angle with respect to the horizontal, said main tray member having a front wall, a rear wall and sidewalls;

a stand member means removably attachable at the rear of said main tray member for raising said main tray member to said selected angle, said stand member having a rear wall and sidewalls, a rear compartment being formed behind said main tray member when said stand means is attached to said main tray member, said rear compartment being formed by the rear wall of said main tray member, the rear wall and sidewalls of said stand means; and a front compartment means for retaining a display card at a second selected angle with respect to the horizontal, said front compartment including a front retaining wall means for holding the bottom of said card, a rear retaining wall means for supporting the back of said card, and a bottom, said back retaining wall means being a portion of said main tray member front wall and said front wall having a reduced height to expose substantially all of the printed material on said display card.

2. The display tray of claim 1 wherein said rear compartment is separated into two compartments by a member extending from said rear wall of said main tray portion.

3. The display tray of claim 1, further including printed directions directing previewing agents to place their business cards in one of said two rear compartments and showing agents to place their business cards in said other of said two rear compartments.

4. The display tray according to claim 1 wherein tabs extend from said main tray member for connecting said stand member to said main tray member, said stand member including lugs over which said tabs extend, said tabs being required to flex outward when connecting or disconnecting said stand member from said main tray member.

5. The display tray of claim 1 wherein said angle is between 10 degrees and 45 degrees.

6. The display tray of claim 1 wherein said front compartment has a retainer portion for retaining a business card at a second angle with respect to the vertical for viewing.

7. The display tray according to claim 4 wherein said lugs include a sloped face region that extends laterally outward such that the width of a lug region contacting said tabs increases as the lug extends rearwardly away from said first member.

8. The display tray according to claim 1 wherein said bottom of said front compartment is in a horizontally flat plane when said stand is attached to said main tray member raising said main tray member to said selected angle.

9. A removable connection between two members, comprising:

(a) a plurality of tabs extending from a first member having slots therein, said tabs being fixedly attached in a spaced relationship to said first member and being flexible;

(b) a plurality of lugs fixedly attached to a second member for receiving said slots of said tabs said lugs having a sloped face region that extends laterally outward such that the width of a lug region contacting said tabs increases as the lug extends rearwardly away from said first member; and (c) a wall portion of said first member abutting against said second member when said slots extend over the lugs.

10. The connection of claim 9 wherein said tabs are flexible to bend for attaching and releasing said tabs from the lug portions.

11. The connection of claim 9 wherein said tabs have a sloped portion for contacting said sloped region of said lug portion when said first and second members are being connected.

12. The connection of claim 9 wherein said first member includes a main tray portion for displaying material and said second member includes a stand portion for elevating said main tray portion to an angle with respect to the horizontal when said members are connected together.

13. The connection of claim 12 wherein said lug has a rear wall at said angle with respect to the vertical.

14. The connection of claim 12 wherein said angle is between 10 degrees and 45 degrees.

15. A display tray comprising:

a main tray member having a bottom positioned at a selected angle with respect to the horizontal, said main tray member having a front wall, a rear wall and sidewalls;

a stand member means removably attachable at the rear of said main tray member for raising said main tray member to said selected angle, said stand member having a bottom, a rear wall, and sidewalls, a rear compartment being formed behind said main tray rear wall when said stand mean is attached to said main tray member, said rear compartment being bounded on the bottom by the bottom of said stand means, on the side by the sidewalls of said stand means, and on the front by the rear wall of said main tray member.

16. The display tray of claim 15 wherein said rear compartment is separated into two compartments by a member extending from said rear wall of said main tray portion.

17. The display tray of claim 15, further including printed directions directing previewing agents to place their business cards in one of said two rear compartments and showing agents to place their business cards in said other of said two rear compartments.

18. The display tray according to claim 15 wherein tabs extend from said main tray member for connecting said stand member to said main tray member, said stand member including lugs over which said tabs extend, said tabs being required to flex outward while said stand member is being connected or disconnected from said main tray member.

19. The display tray of claim 15 wherein said angle is between 10 degrees and 45 degrees.

20. The display tray according to claim 18 wherein said lugs include a sloped face region that extends laterally outward such that the width of a lug region contacting said tabs increases as the lug extends rearward away from said first member.

* * * * *